US006168484B1

(12) United States Patent
Mishima et al.

(10) Patent No.: US 6,168,484 B1
(45) Date of Patent: Jan. 2, 2001

(54) INTAKE APPARATUS OF OUTBOARD MOTOR

(75) Inventors: Shuichi Mishima, Iwata; Toshio Watanabe; Hidetsugu Shimada, both of Hamamatsu; Katsuhiro Fukuda, Shizuoka-ken; Jun Itoh, Hamamatsu; Satoru Takahashi, Hamamatsu; Shuichi Hagino, Hamamatsu, all of (JP)

(73) Assignee: Suzuki Kabushiki Kaisha, Hamamatsu (JP)

( * ) Notice: Under 35 U.S.C. 154(b), the term of this patent shall be extended for 0 days.

(21) Appl. No.: 09/092,895

(22) Filed: Jun. 8, 1998

(30) Foreign Application Priority Data

Jun. 9, 1997 (JP) ..... 9-151241

(51) Int. Cl.[7] ..... B63H 21/10; F02M 35/10
(52) U.S. Cl. ..... 440/88; 123/184.21
(58) Field of Search ..... 440/88, 900, 89; 123/184.21, 184.32, 184.46, 463, 516; 181/229, 243

(56) References Cited

U.S. PATENT DOCUMENTS 5,438,963 * 8/1995 Tsunoda et al. ..... 123/54.4
5,445,547 * 8/1995 Furukawa ..... 440/77
5,489,227 * 2/1996 Ishida et al. ..... 440/77
5,501,202 * 3/1996 Watanabe ..... 123/572
5,683,277 * 11/1997 Tsunoda et al. ..... 440/88
5,915,363 * 6/1999 Iwata et al. ..... 123/497

FOREIGN PATENT DOCUMENTS 4-1661 1/1992 (JP) .
6-129316 5/1994 (JP) .
8-93581 4/1996 (JP) .

* cited by examiner

*Primary Examiner*—S. Joseph Morano
*Assistant Examiner*—Patrick Craig Muldoon
(74) *Attorney, Agent, or Firm*—Finnegan, Henderson, Farabow, Garrett & Dunner, L.L.P.

(57) ABSTRACT

An outboard motor includes an engine holder, an engine installed above the engine holder, an intake apparatus disposed on one side of the engine, and an electric equipment box and an exhaust apparatus both disposed on another side of the engine. The intake apparatus comprises a throttle body installed in a front portion of the engine, a silencer operatively connected to an upstream side of the throttle body, a surge tank disposed on one side of the engine, and an intake manifold operatively connected to the surge tank. The silencer extends around a front side of the engine towards the exhaust apparatus. The silencer is provided with an upstream end portion to which an intake port is formed to open rearward. The upstream end portion may be fixed to a wall portion of the electric equipment box and the upstream end portion of the silencer has a lower surface to which an intake port is formed so that it opens downward.

7 Claims, 7 Drawing Sheets

INTAKE APPARATUS OF OUTBOARD MOTOR

BACKGROUND OF THE INVENTION

The present invention relates to an intake apparatus of an outboard motor.

In general, since an outboard motor is used in a relatively clean environment, open air is usually directly drawn into an engine of the outboard motor without passing through an air cleaner. Therefore, the outboard motor requires a silencer (intake noise silencing device) for lowering noise generated during the air drawing.

Conventionally, the outboard motor utilizes an intake apparatus in which a fuel is atomized and mixed by means of a carburetor in many cases. A silencer is generally disposed by utilizing a space along a side of the engine body.

However, there is a tendency in recent years that an outboard motor of a fuel injection type has been employed instead of a carburetor. In this type, most of space on the side of the engine body is occupied by an intake manifold, a surge tank and the like, and a space for disposing the silencer hence becomes small.

A conventional fuel injection type engine does not include the silencer as disclosed, for example, in Japanese Patent Laid-open Publication No.HEI 6-129316, or includes a small-sized silencer as disclosed in Japanese Patent Laid-open Publication No.HEI 8-93581 and Japanese Utility Model Laid-open Publication No.HEI 4-1661. As a result, according to the structures mentioned above, the intake noise cannot be sufficiently lowered.

SUMMARY OF THE INVENTION

An object of the present invention is to substantially eliminate defects or drawbacks encountered in the prior art mentioned above and to provide an intake apparatus of an outboard motor having an improved structure capable of reducing an intake noise with a compact structure.

Another object of the present invention is to provide an intake apparatus of an outboard motor capable of improving intake performance and reliability.

These and other objects can be achieved according to the present invention by providing, in one aspect, an intake apparatus of an outboard motor which includes an engine holder, an engine disposed above the engine holder in an installed state of the outboard motor, an intake apparatus disposed on one side of the engine, and an electric equipment box and an exhaust apparatus both disposed on another one side of the engine, the intake apparatus comprising:

- a throttle body disposed to a front portion of the engine in an installed state of the outboard motor;
- a silencer means operatively connected to an upstream side of the throttle body;
- a surge tank disposed at a side portion of the engine; and
- an intake manifold operatively connected to the surge tank,
- wherein the silencer means extends so as to round a front side of the engine towards the exhaust apparatus and the silencer means is provided with an upstream end portion to which an intake port is formed so as to open rearward.

The intake port is opened toward a front side of the electric equipment box. The silencer means is formed in a manner such that the silencer means once extends diagonally upward to form an inclining portion and then extends substantially horizontally, and the intake port is disposed at a position higher than the throttle body.

In another aspect, there is provided an intake apparatus of an outboard motor which includes an engine holder, an engine disposed above the engine holder in an installed state of the outboard motor, an intake apparatus disposed on one side of the engine, and an electric equipment box and an exhaust apparatus both disposed on another one side of the engine, the intake apparatus comprising:

- a throttle body disposed to a front portion of the engine in an installed state of the outboard motor;
- a silencer means operatively connected to an upstream side of the throttle body;
- a surge tank disposed at a side portion of the engine; and
- an intake manifold operatively connected to the surge tank,
- wherein the silencer means extends so as to round a front side of the engine towards the exhaust apparatus, the silencer means is provided with an upstream end portion which is fixed to a wall portion of the electric equipment box and the upstream end portion of the silencer means has a lower surface to which an intake port is formed so as to open downward.

In this aspect, the silencer means may be also formed in a manner such that the silencer means once extends diagonally upward to form an inclining portion and then extends substantially horizontally and the intake port is disposed at a position higher than the throttle body.

The engine is provided with a cylinder head covered by a cylinder head cover in which breather chamber is formed, and a breather hose for introducing blowby gas from the breather chamber and an evaporation hose for introducing vaporized fuel are connected to the inclining portion of the silencer means.

An intake temperature sensor is disposed at a portion to which these hoses are attached.

According to the preferred embodiments of the intake apparatus of an outboard motor mentioned above, the silencer can be formed with an increased inner volume and has an improved structure capable of reducing the silencing noise effectively, being comfortable for an operator.

These and other advantageous effects can be attained with an improved compact structure of the intake apparatus.

The nature and further features of the present invention will be made more clear from the following descriptions made with reference to the accompanying drawings.

DESCRIPTION OF THE PREFERRED EMBODIMENTS

Figure 1:
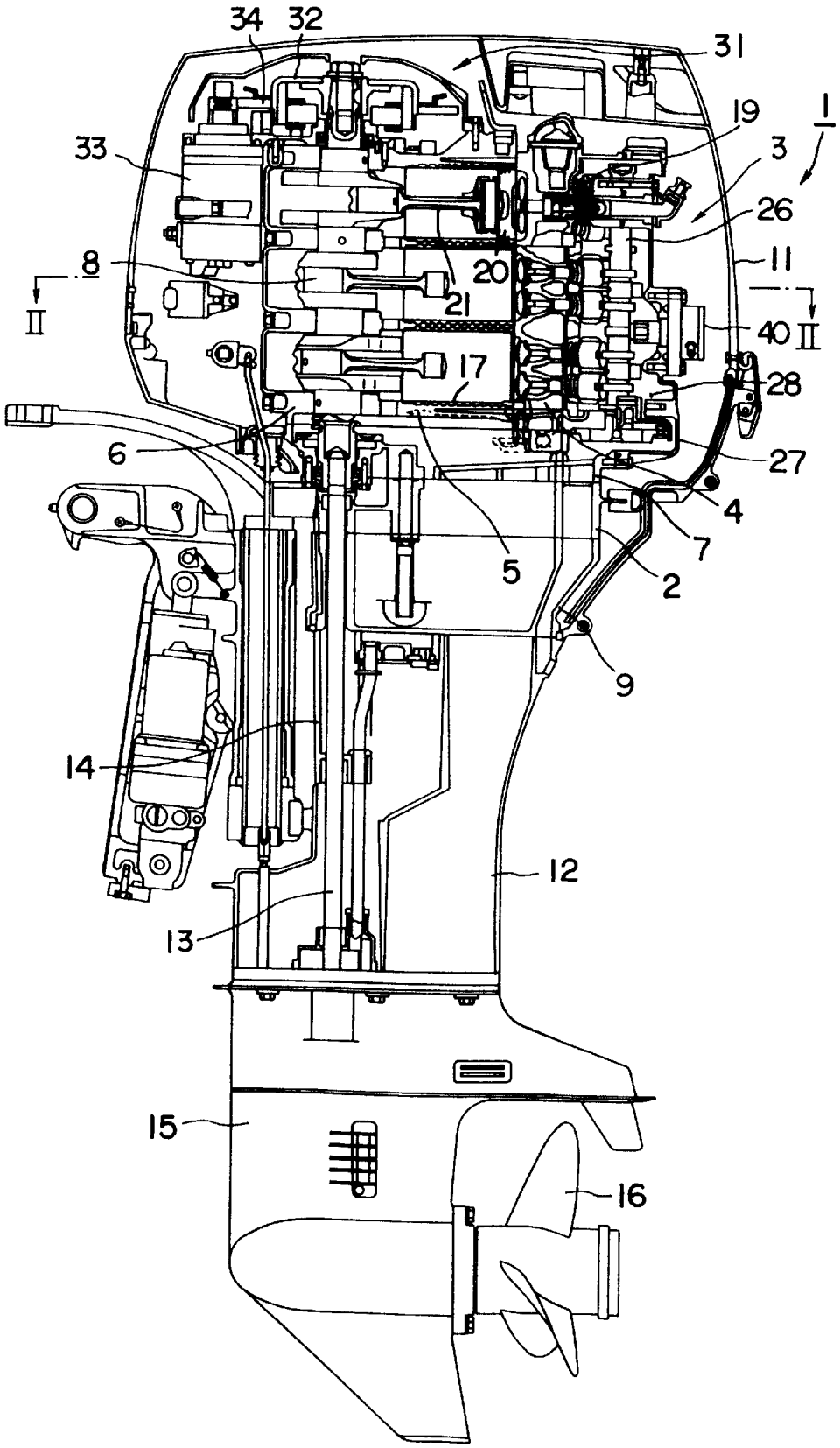
FIG. 1 is a left longitudinal sectional view of an outboard motor showing a first embodiment of the present invention in a state to be mounted to a hull, for example.

Preferred embodiments of the present invention will be described hereunder with reference to the accompanying drawings.

Referring to FIGS. 1 to 4, an outboard motor 1 of the first embodiment includes an engine holder 2 and an engine 3 disposed on the engine holder 2 in an installed state. The engine 3 is, for example, a water-cooled four-stroke-cycle three-cylinder engine and comprises, in combination, a cylinder head 4, a cylinder block 5, a crankcase 6 and the like. The engine 3 is disposed on an engine holder 2 through a cam chain case 7.

Figure 2:
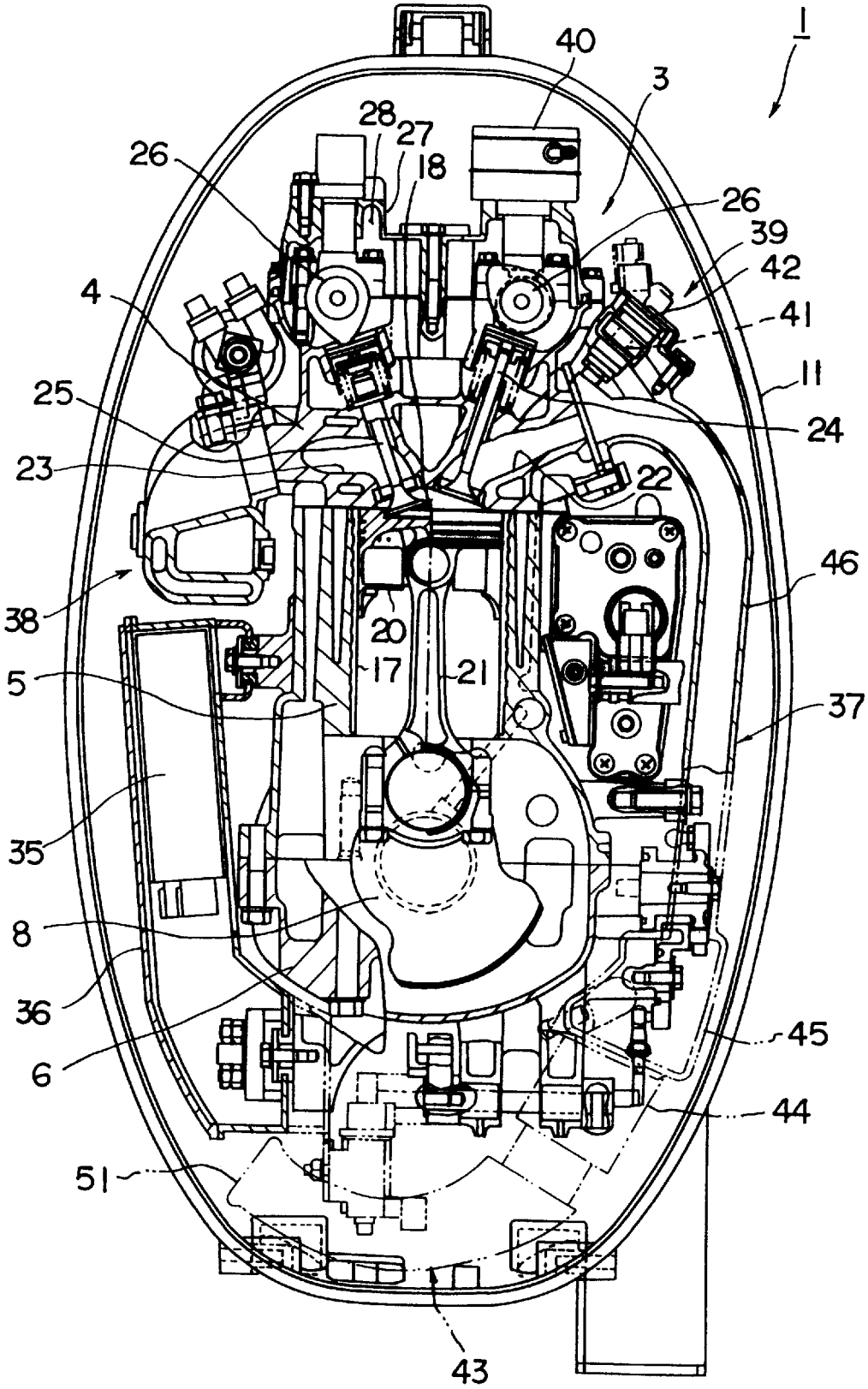
FIG. 2 is a sectional view taken along the line II—II in FIG. 1.
Figure 3:
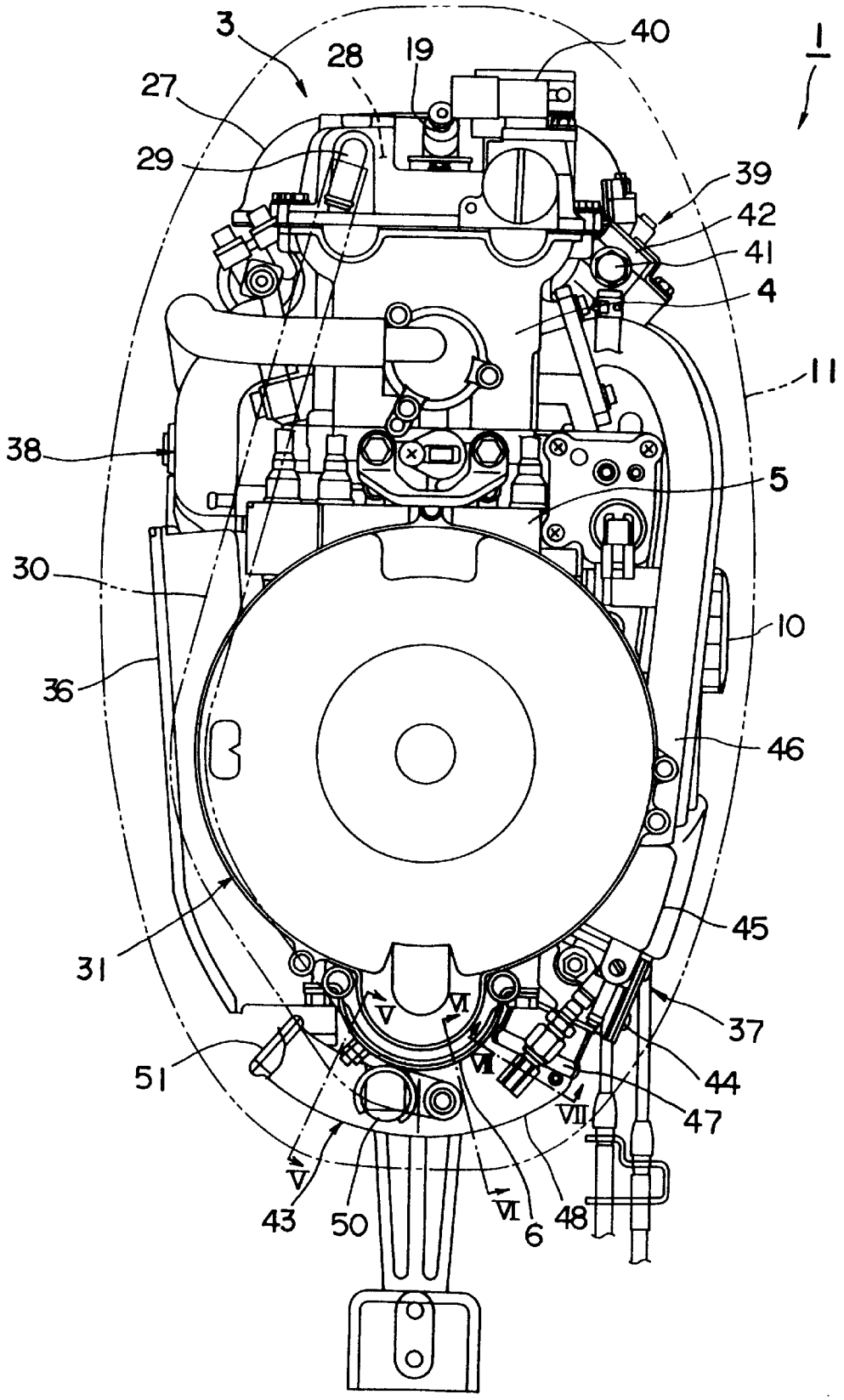
FIG. 3 is a plan view of the outboard motor shown in FIG. 1.

The cylinder block 5 is disposed in a rear side of the crankcase 6, at the right side in FIG. 1, and in an upper portion in FIGS. 2 and 3. The cylinder head 4 is disposed in the rear side of the cylinder block 5. The cam chain case 7 is disposed below the crankcase 6, the cylinder block 5 and the cylinder head 4.

A crankshaft 8 is vertically disposed within the crankcase 6, and an oil pan 9 is disposed below the engine holder 2. The engine 3 is provided at its left side lowest portion with an oil filter 10 and an engine cover 11 covers an area from the engine 3 to the oil pan 9.

A drive shaft housing 12, in which a drive shaft 13 is accommodated, is disposed below the oil pan 9. An upper end portion of the drive shaft 13 is, for example, spline-fitted to a lower end portion of the crankshaft 8. The drive shaft 13 extends downward in a shaft pipe 14 formed within the drive shaft housing 12 and the drive shaft 13 drives a propeller 16 through a bevel gear and a propeller shaft (both not shown) in a gear case 15 provided below the drive shaft housing 12.

A combustion chamber is formed in the cylinder head 4 of the engine 3 in alignment with a cylinder 17 formed in the cylinder block 5 horizontally, and a spark plug 19 is connected to the combustion chamber 18 from an outside portion. A piston 20 is slidably inserted in the cylinder 17 horizontally. The piston 20 and the crankshaft 8 are coupled through a connecting rod 21. Reciprocating stroke of the piston 20 is converted into revolution movement of the crankshaft 8.

On the other hand, an intake port 22 and an exhaust port 23, which are connected to the combustion chamber 18, are formed in the cylinder head 4. An intake valve 24 and an exhaust valve 25 are disposed in the cylinder head 4 for opening and closing both the intake and exhaust ports 22 and 23. A cam shaft 26 is disposed in the rear portion of the cylinder head 4 for opening and closing the intake and exhaust valves 24 and 25. A cam chain, not shown, is disposed in the cam chain case 7, and the cam shaft 26 and the crankshaft 8 are operatively connected to each other through the cam chain.

The rear portion of the cylinder head 4 is covered with a cylinder head cover 27, and a breather a chamber 28 is formed in the cylinder head cover 27. The cylinder head cover 27 is provided with a discharge pipe 29 for discharging blowby gas in the breather chamber 28, and a breather hose 30 is connected to this discharge pipe 29.

A flywheel magnet device 31 for generating electricity is provided on an upper end of the crankshaft 8 disposed above the upper portion of the engine 3. A ring gear 34 which is operatively connected to a starter motor 33 disposed in front of the engine 3 is formed around an outer periphery of the flywheel 32. An electric equipment box 36 accommodating an electric equipment 35, an intake apparatus 37, an exhaust apparatus 38, a fuel supply apparatus 39 and the like are disposed on the side of the engine 3.

The fuel supply apparatus 39 includes fuel system components such as a filter and a pump. More specifically, the fuel supply apparatus 39 comprises a connector, a fuel filter (both not shown), a fuel pump 40 disposed on the cylinder head cover 27 and driven by the camshaft 26, a vapor separator, a pressure regulator (both not shown), a delivery pipe 41, a fuel injector 42 and the like. These components are connected to one another through fuel hoses which are not shown.

The intake apparatus 37 mainly comprises a silencer 43, a throttle body 44, a surge tank 45 and an intake manifold 46 and is disposed on one side of the engine 3. The electric equipment box 36 is disposed in front of the engine 3 on the opposite side to the intake apparatus 37. The exhaust apparatus 38 is disposed in the rear portion of the electric equipment box 36.

The throttle body 44 is disposed in diagonally front of the crankcase 6 of the engine 3, for example, and the surge tank 45 is juxtaposed on the side of the engine 3 downstream, i.e. rear side, of the throttle body 44. The intake manifold 46 extends from the surge tank 45 to each cylinder and connected to the intake port 22.

Figure 4:
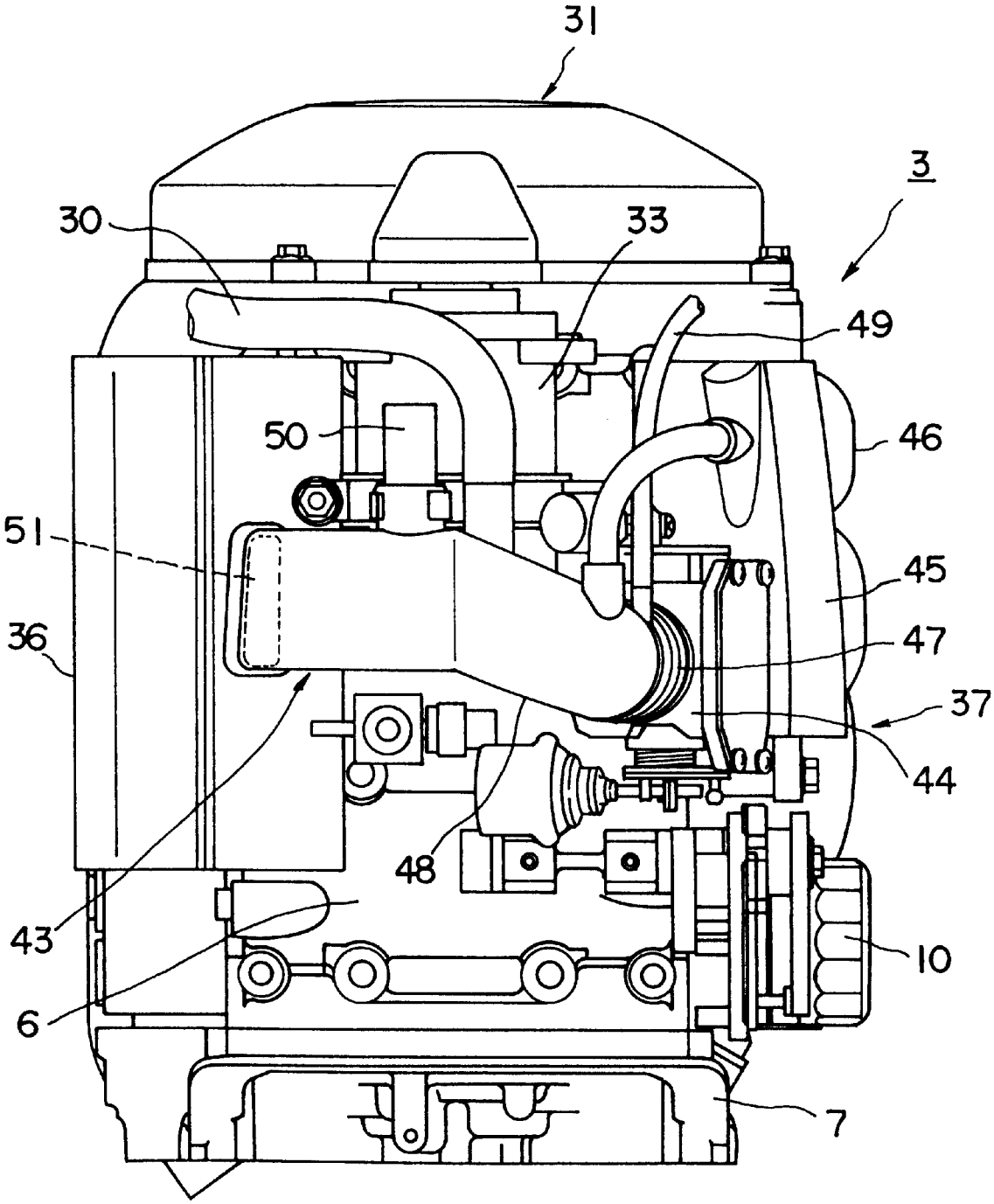
FIG. 4 is a front view of the outboard motor shown in FIG. 1.

The silencer 43 is for reducing intake noise, is connected to an upstream portion (i.e. a front portion) of the throttle body 44 as shown in FIGS. 3 and 4 and is fastened by a clamp 47. The silencer 43 once extends diagonally upward to form an inclining portion 48 and then extends substantially in a horizontal direction so as to round a front side of the engine 3 to reach a front side of the electric equipment box 36.

The breather hose 30 is connected to the inclining portion 48 of the silencer 43, and blowby gas from the breather chamber 28 is introduced into the inclining portion 48. An evaporation hose 49 for introducing vaporized fuel from the vapor separator (not shown) is also connected to the inclining portion 48 of the silencer 43. An intake air temperature sensor 50 is disposed upstream of the hose fixtures.

Figure 5:
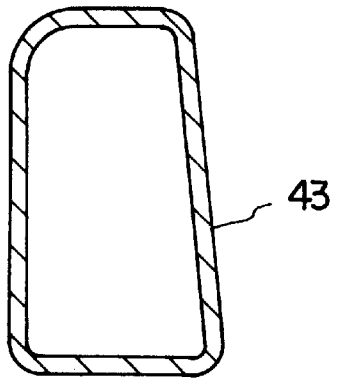
FIG. 5 is a sectional view taken along the line V—V in FIG. 3.
Figure 6:
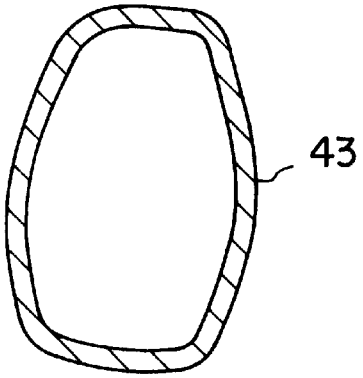
FIG. 6 is a sectional view taken along the line VI—VI in FIG. 3.
Figure 7:
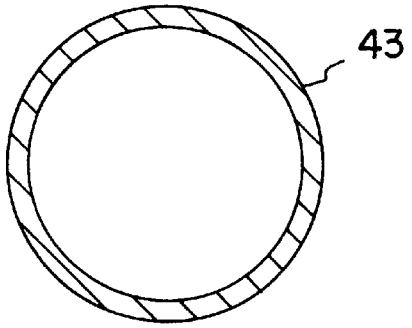
FIG. 7 is a sectional view taken along the line VII—VII in FIG. 3.

As shown in FIGS. 5, 6 and 7 (which are sectional views taken along the lines V—V, VI—VI, and VII—VII, respectively), various portions of the silencer 43 are formed differently in sections in accordance with a mounting position and an outline of the adjacent engine 3.

The silencer 43 shown in FIGS. 3 and 4 is of the first embodiment of the present invention, in which the silencer 43 is provided at its upstream end portion with an intake port 51 opened rearward (i.e. toward a front side of the electric equipment box 36). The intake port 51 is disposed at a position higher than the throttle body 44.

Figure 8:
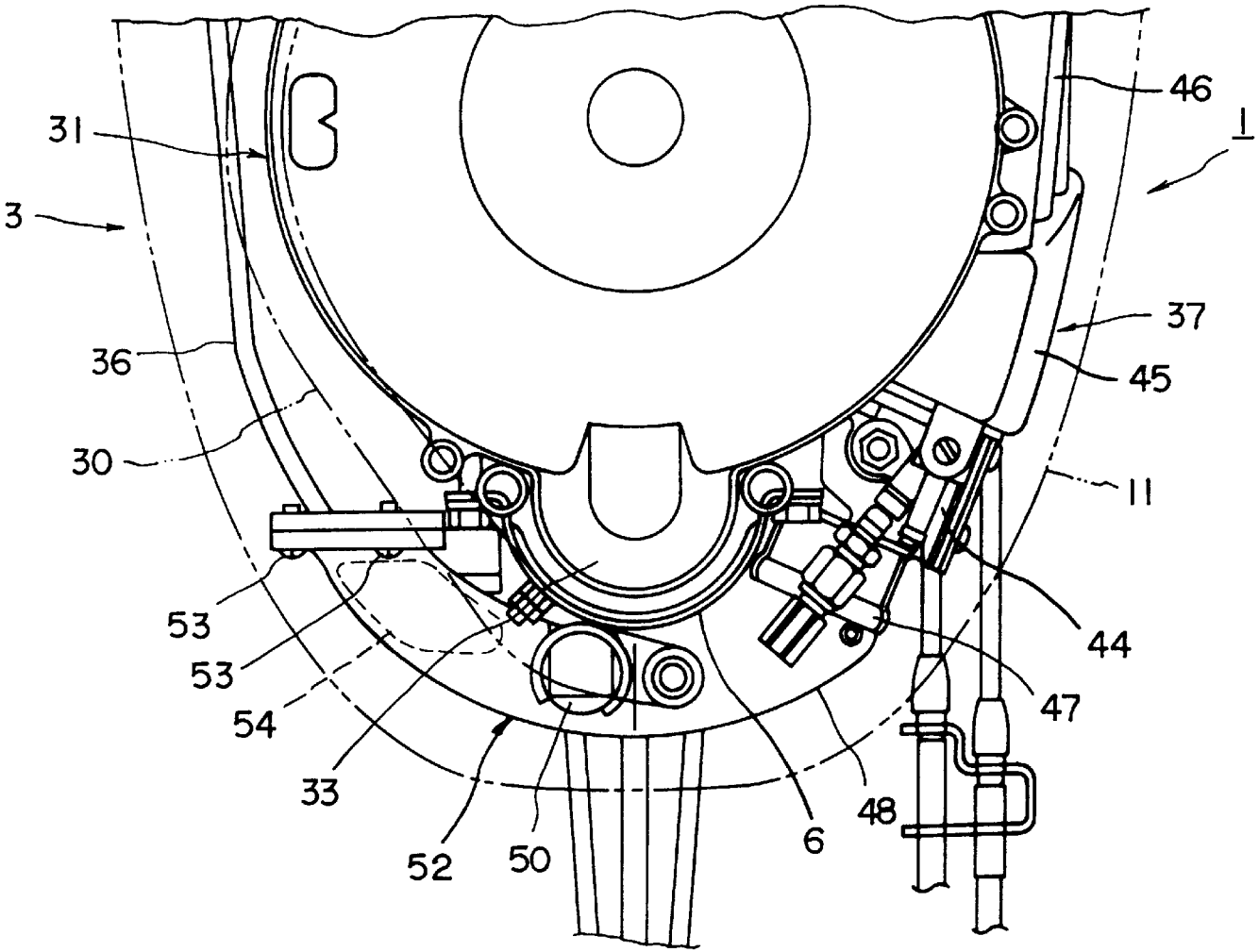
FIG. 8 is an enlarged plan view of the engine front portion of a second embodiment.
Figure 9:
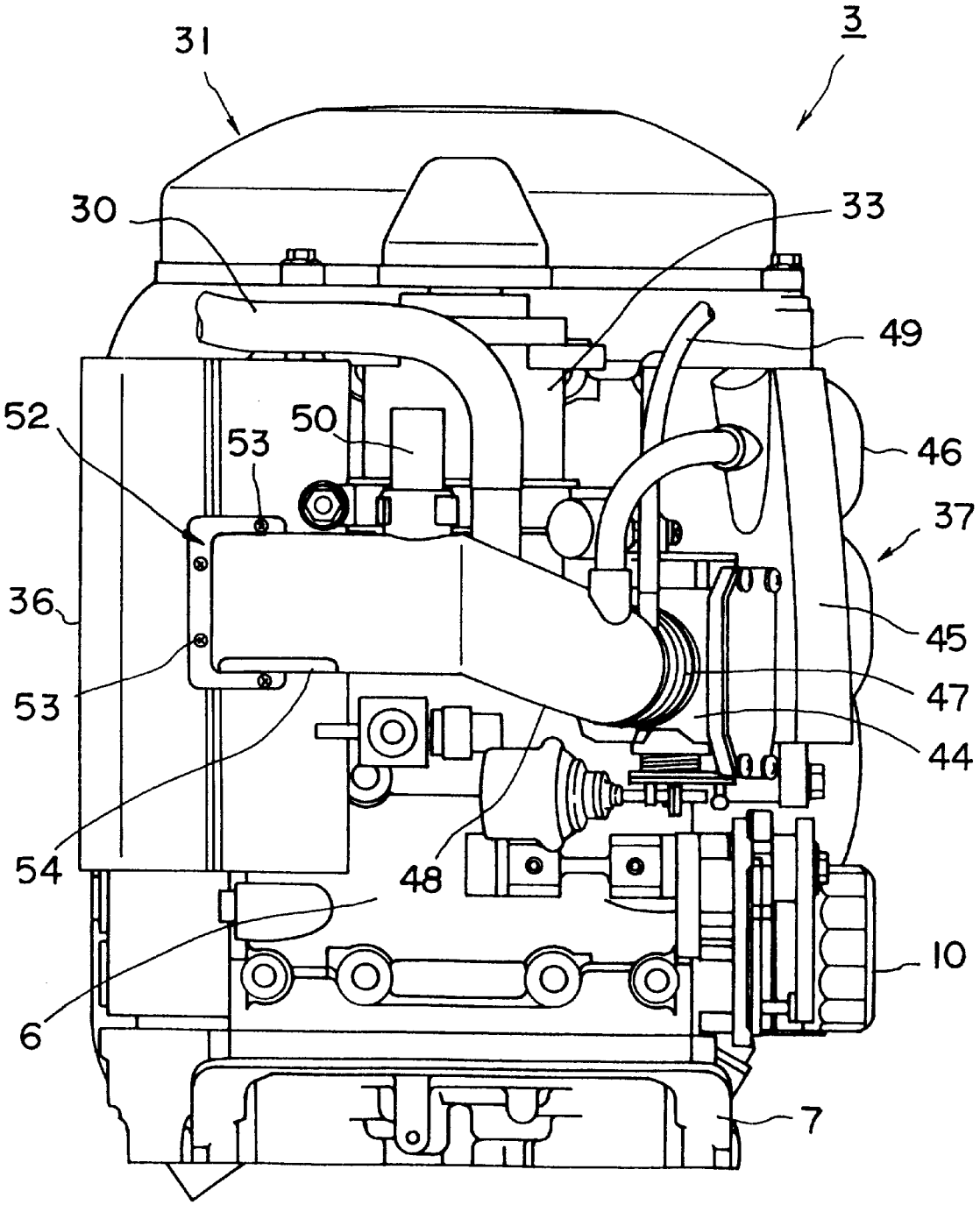
FIG. 9 is a front view of the outboard motor of the second embodiment.

On the other hand, FIGS. 8 and 9 show a second embodiment of the present invention. FIG. 8 is an enlarged plan view of a front portion of the engine 3 and FIG. 9 is a front view of the outboard motor 1. Elements similar to those shown in the first embodiment are denoted by the same reference numerals.

As shown in FIGS. 8 and 9, a silencer 52 of the second embodiment extends to round a front side of the engine 3 to reach a front side of the electric equipment box 36, and an upstream end portion of the silencer 52 is fixed and supported to a wall surface of the electric equipment box 36 through a screw 53 or the like. The intake port 54 is opened downward at a lower surface of the upstream end portion of the silencer 52.

An operation of the embodiments will be explained hereunder.

Since the silencer 43 connected to the throttle body 44 extends so as to round the front side of the engine 3 to reach the front side of the electric equipment box 36, it is possible to increase the volume of the silencer 43 without necessitating a large space. As a result, sound silencing effect for the intake noise can be enhanced.

Further, since the sections of various portions of the silencer 43 are formed differently in accordance with a mounting position and an outline of the adjacent engine 3, it is possible to reduce the silencer 43 in size while keeping a sufficient volume of the silencing volume.

Furthermore, since the intake port 51 of the silencer 43 is opened rearward, i.e., toward electric equipment box 36, intake noise is emanated rearward of the driver. Therefore, intake noise is hardly transmitted to the driver and degree of silencing performance can be improved.

The silencer 43 is formed with the inclining portion 48, the intake port 51 is disposed at a position higher than the throttle body 44, and the breather hose 30 and the evaporation hose 49 are connected to the inclining portion 48. Therefore, the structure is simplified, and the blowby gas introduced by the breather hose 30 and vaporized fuel introduced by the evaporation hose 49 are not discharged from the intake port 51 but is introduced by the throttle body 44. As a result, performance and reliability of the intake apparatus 37 can be improved.

Further, as shown in the second embodiment, if the upstream end portion of the silencer 52 is fixed to the wall surface of the electric equipment box 36, the silencer 52 is supported at its opposite ends, which is advantageous in terms of vibration. In this case, since the intake port 54 is opened at the lower surface of the silencer 52, an intake noise is hardly transferred to the driver and degree of silencing performance can be further improved as in the first embodiment.

It is to be noted that the present invention is not limited to the described embodiments and many other changes and modifications may be made without departing the scopes of the appended claims.

What is claimed is:

1. An intake apparatus of an outboard motor which includes an engine holder, an engine installed on the engine holder, an intake apparatus disposed on one side of the engine, and an electric equipment box and an exhaust apparatus both disposed on another side of the engine, said intake apparatus comprising:

a throttle body installed in a front portion of the engine;

a silencer operatively connected to an upstream side of the throttle body;

a surge tank disposed on one side of the engine; and an intake manifold operatively connected to the surge tank, wherein said silencer extends around a front side of the engine towards the exhaust apparatus and said silencer is provided with an upstream end portion to which an intake port is formed to open rearward.

2. An intake apparatus of an outboard motor according to claim 1, wherein said intake port is opened toward a front side of said electric equipment box.

3. An intake apparatus for an outboard motor according to claim 1, wherein said silencer is formed in a manner such that a portion of the silencer extends diagonally upward to form an inclining portion and another portion of the silencer extends substantially horizontally, and said intake port is disposed at a position higher than the throttle body.

4. An intake apparatus of an outboard motor which includes an engine holder, an engine installed on the engine holder, an intake apparatus disposed on one side of the engine, and an electric equipment box and an exhaust apparatus both disposed on another side of the engine, said intake apparatus comprising:

a throttle body installed in a front portion of the engine;

a silencer operatively connected to an upstream side of the throttle body;

a surge tank disposed on one side of the engine; and an intake manifold operatively connected to the surge tank, wherein said silencer extends around a front side of the engine towards the exhaust apparatus, said silencer is provided with an upstream end portion which is fixed to a wall of the electric equipment box and said upstream end portion of the silencer has a lower surface to which an intake port is formed to open downward.

5. An intake apparatus of an outboard motor according to claim 4, wherein said silencer is formed in a manner such that a portion of the silencer extends diagonally upward to form an inclining portion and a portion of the silencer extends substantially horizontally, and said intake port is disposed at a position higher than the throttle body.

6. An intake apparatus of an outboard motor according to claim 4, wherein said engine is provided with a cylinder head covered by a cylinder head cover in which a breather chamber is formed, a breather hose for moving gas from the breather chamber to the inclining portion of said silencer, and an evaporation hose connected to said inclining portion of the silencer.

7. An intake apparatus of an outboard motor according to claim 6, wherein an intake temperature sensor is disposed adjacent the portion of the silencer to which said breather hose and evaporation hose are attached.

* * * * *